US005272486A

United States Patent [19]

Dickinson

[11] Patent Number: 5,272,486

[45] Date of Patent: Dec. 21, 1993

[54] ANTENNA ERECTOR FOR A TOWED BUOYANT CABLE

[75] Inventor: Stuart C. Dickinson, Bristol, R.I.

[73] Assignee: The United States of America as represented by the Secretary of the Navy, Washington, D.C.

[21] Appl. No.: 918,085

[22] Filed: Jul. 24, 1992

[51] Int. Cl.[5] ..... H01Q 1/34; H01Q 1/04

[52] U.S. Cl. ..... 343/719; 343/709; 343/881

[58] Field of Search ..... 343/719, 709, 711, 712, 343/713, 715, 881, 882, 900, 888, 880

[56] References Cited

U.S. PATENT DOCUMENTS

| | | | |
|---|---|---|---|
| 3,587,103 | 6/1971 | Lawrie | 343/709 |
| 4,101,897 | 7/1978 | Morrison | 343/881 |
| 4,254,419 | 3/1981 | Noddin | 343/715 |
| 5,195,796 | 3/1993 | Wampler, II | 16/358 |

*Primary Examiner*—Donald Hajec
*Assistant Examiner*—Hoanganh Le
*Attorney, Agent, or Firm*—Michael J. McGowan; Prithvi C. Lall; Michael F. Oglo

[57] ABSTRACT

An apparatus is provided for erecting and stowing a communications antenna from an underwater buoyant cable. In its stowed position, the antenna is approximately parallel to the cable. In its erected position, the antenna is approximately perpendicular to the cable. A hinge, spring biased to maintain the antenna in its stowed position, is connected to the cable and to one end of the antenna. A shape memory alloy actuator is connected to the cable and the antenna. The actuator overcomes the spring bias of the hinge to raise the antenna to its erected position when energy of activation is supplied thereto. Further, the actuator allows the spring bias of the hinge to return the antenna to its stowed position when the energy of activation is removed therefrom.

10 Claims, 2 Drawing Sheets

ANTENNA ERECTOR FOR A TOWED BUOYANT CABLE

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to mechanical erectors and more particularly to an antenna erector for a towed buoyant cable that uses a shape memory alloy to raise an antenna.

(2) Description of the Prior Art

Communication with and between underwater vehicles currently makes use of towed buoyant cables that are equipped to transmit and receive electromagnetic radio waves. Since seawater is electrically conducting, penetration of the radio frequency electromagnetic waves below the surface of the water is limited. Furthermore, as the frequency of the electromagnetic waves increases, penetration depth of the electromagnetic waves decreases. Accordingly, the cables are made buoyant to maintain the transmit/receive components at the surface of the water. Unfortunately, the cables frequently experience wave "wash over" during transmission/reception. Wave wash over essentially increases the amount of water over the cable which may interrupt communications. In addition, underwater vehicles often need to communicate when traveling at speeds that generate hydrodynamic forces that may pull the towed cable below the surface of the water.

One way to counter these problems is to mount an antenna on the towed buoyant cable. The height of the antenna would be such that it would extend from the surface of the water during wash over and when the underwater vehicle was traveling fast enough to pull the towed cable below the surface. However, an erected antenna would not survive many of the operational maneuvers of underwater vehicles. Furthermore, maintaining an antenna above the surface of the water is contrary to the notion of (underwater) stealth vehicles.

SUMMARY OF THE INVENTION

Accordingly, it is an object of the present invention to provide an antenna system for a towed buoyant cable that can be maintained above the surface of the water for purposes of communication and maintained below the surface of the water for purposes of stealth and underwater vehicle maneuvers.

Another object of the present invention is to provide an antenna erector for a towed buoyant cable that is compatible with a seawater environment and the hydrodynamic forces experienced therein.

Other objects and advantages of the present invention will become more obvious hereinafter in the specification and drawings.

In accordance with the present invention, an apparatus is provided for erecting and stowing a communications antenna from an underwater buoyant cable that houses a plurality of electric current carrying lines. In its stowed position, the antenna is approximately parallel to and maintained within the circumferential confines of the cable. In its erected position, the antenna is approximately perpendicular to the cable. A hinge is spring biased to maintain the antenna in its stowed position. The hinge is connected to the cable and to one end of the antenna such that the other end of the antenna points substantially in the direction of water flow past the cable. A shape memory alloy actuator means is connected to the cable and the antenna. The actuator means overcomes the spring bias of the hinge to raise the antenna to its erected position when energy of activation is supplied thereto. Further, the actuator means allows the spring bias of the hinge to return the antenna to its stowed position when the energy of activation is removed therefrom.

BRIEF DESCRIPTION OF THE DRAWINGS

Other objects, features and advantages of the present invention will become apparent upon reference to the following description of the preferred embodiments and to the drawings, wherein.

DESCRIPTION OF THE PREFERRED EMBODIMENT

Figure 1:
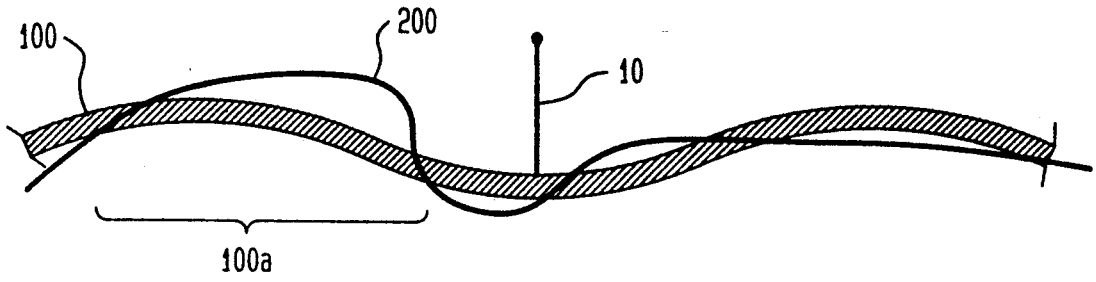
FIG. 1 is a section of a buoyant communications cable shown floating at the surface of the ocean.

Referring now to the drawings, and in particular to FIG. 1, a section of a buoyant communications cable 100 is shown floating at the surface of the ocean 200. Typically, cable 100 is attached to a tow vehicle (not shown) such as a submarine. As is readily expected in the ocean, the surface thereof changes according to the sea swell. Thus, at any given point along cable 100, the surface of the ocean 200 may wash over cable 100 as shown along cable section 100*a*. Accordingly, it is desirable to provide a communications antenna 10 extending up from cable 100 above the maximum expected sea swell. This allows the tow vehicle to transmit and receive electromagnetic communications signals in an uninterrupted fashion since the antenna rides above the height of any wave wash over. However, as mentioned above, maintaining antenna 10 in this erect position identifies the presence and position of the tow vehicle. In addition, antenna 10 is always subjected to the maneuvers of the tow vehicle and is susceptible to damage from floating debris.

Thus, the present invention provides a means for erecting antenna 10 when needed for communications purposes and for stowing antenna 10 when communications have ended. It should be appreciated that any such erecting means must be capable of withstanding extended exposure to seawater at the surface and at great depths. Further, the erecting means must be relatively compact since a typical buoyant cable is only about two inches in diameter. The erecting means should also be capable of quiet operation since one of the goals of a tow vehicle such as a submarine is to maintain audio stealth as well as visual stealth. With these criteria in mind, a preferred embodiment of the present invention will now be described with reference to FIGS. 2 and 3. As will be readily apparent to one skilled in the art, the present invention is not limited to this embodiment.

Indeed, many alternatives to this embodiment will be noted in the ensuing description.

Figure 2:
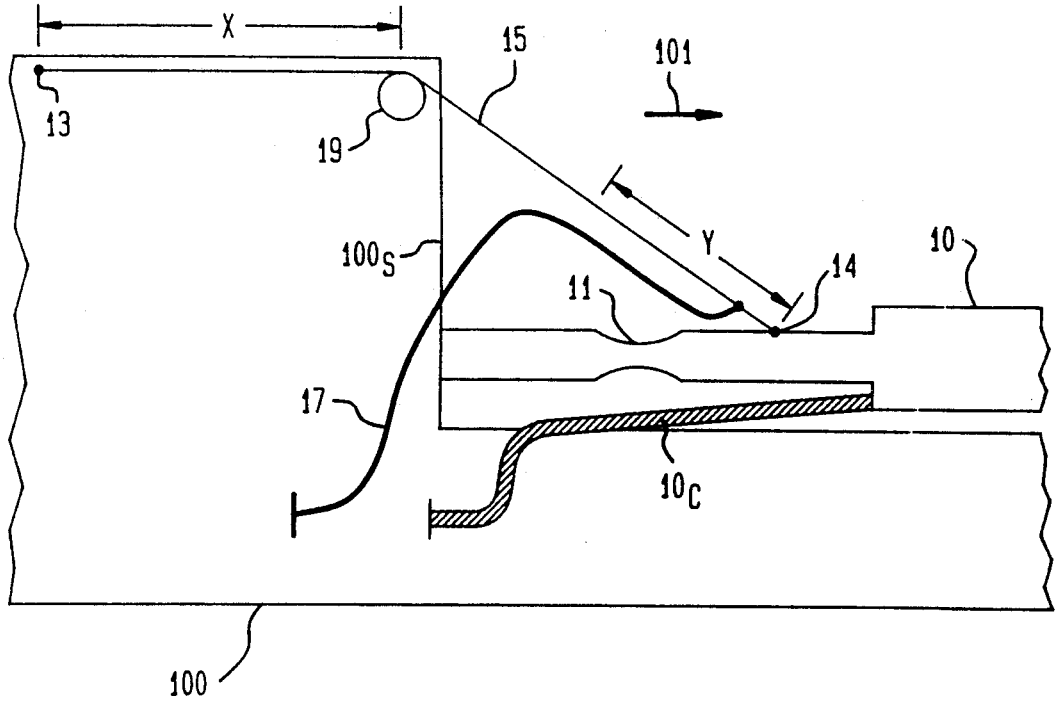
FIG. 2 is a side view of a section of the buoyant cable that houses the apparatus of the present invention and shows a communications antenna in its stowed position.

FIG. 2 is an expanded side view of a section of cable 100 that houses the apparatus of the present invention and shows antenna 10 in its stowed position. In this position, the free or outboard end (not shown) of antenna 10 typically points in the direction of water flow past cable 100 as indicated by flow arrow 101. Note that flow 101 could be due to water current acting on a stationary cable or water movement due to a tow vehicle's movement. In this way, hydrodynamic forces can be utilized to maintain antenna 10 in its stowed position.

A slot or chamber 100*s* is provided in cable 100 to house the antenna 10 in its stowed position. Alternatively, antenna 10 could be stowed alongside and parallel to cable 100. However, for reasons of practicality, slot 100*s* of length suitable to accommodate antenna 10 is provided to protect antenna 10 in this stowed position and to minimize hydrodynamic drag as cable 100 is towed through the water. An antenna cable 10*c* is also provided within (and extending from) cable 100 to carry the communication signals from/to transmit/-receive apparatus on board the tow vehicle. Sufficient slack must be provided in antenna cable 10*c* to accommodate antenna 10 in both its stowed and erect positions.

A hinge 11 is used to connect antenna 10 to cable 100. Hinge 11 must be spring biased to maintain antenna 10 in its stowed position absent any other forces. The choice of hinge design may vary depending on the specific application. Some examples include a corrosion resistant metal (such as stainless steel or bronze) or plastic (such as nylon) leaf spring construction. Alternatively, a simple hinge and spring combination could be used. In all cases, however, care should be taken to assure the hinge's ability to operate during long term exposure to a seawater environment.

Connected to both cable 100 at position 13 and antenna 10 at position 14, is a shape memory alloy (SMA) wire 15 which serves as the actuator for hinge 11. The SMA wire 15 is within the circumferential confines of the cable 100. An electrically conducting wire 17 is also connected to SMA wire 15 as shown. The exact location of such connection is a design choice and in no way limits the present invention. Conducting wire 17 transports heating current to SMA wire 15 to actuate same as will be explained further hereinbelow. Conducting wire 17 may be one of several conducting wires housed within cable 100. As with antenna cable 10*c*, conducting wire 17 should have sufficient slack as shown to accommodate antenna 10 in both its stowed and erect positions. Note that both conducting wire 17 and antenna cable 10*c* are typically maintained within a conductor bundle (not shown) that runs within and along one side of cable 100. Finally, guide means 19, such as a bushing or pulley, may be provided on cable 100 to guide SMA wire 15 as will now be explained in further detail.

Figure 3:
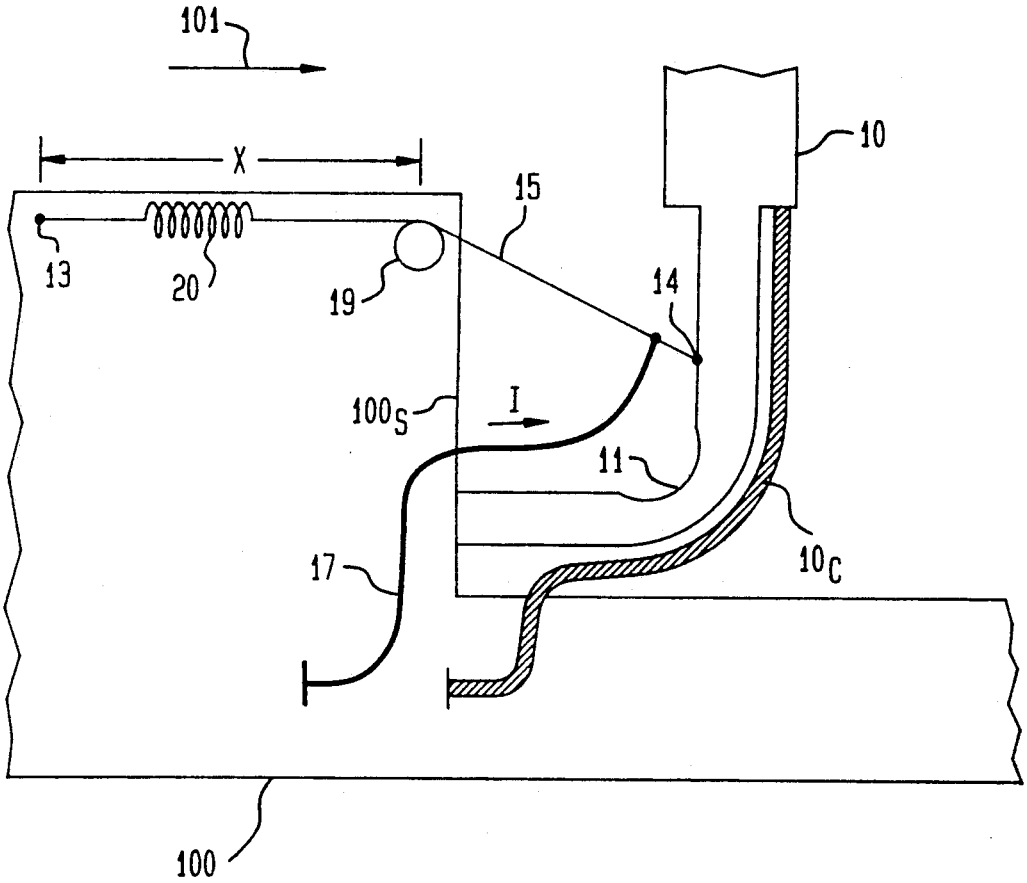
FIG. 3 is a side view of a section of the buoyant cable showing the communications antenna in its erected position.

In operation, a heating current I is supplied to SMA wire 15 to raise the temperature of the SMA material above its transition point i.e., the temperature at which the crystalline lattice structure changes thereby changing the length of wire. As shown in FIG. 3 (where like reference numerals have been used in for those elements common with FIG. 2), when heated by current I, SMA wire 15 shrinks to overcome the spring bias of hinge 11 and raise antenna 10 to its erect position. Specifically, for the construction shown in this embodiment, SMA wire 15 must shrink an amount y (shown in FIG. 2) to raise antenna to its approximately perpendicular erect position. Since the length of SMA wire 15 from position 13 to guide means 19 is fixed at the value of x, the ratio of y/x may be used in conjunction with the known properties of the chosen SMA material to properly select the relaxed or non-activated length of SMA wire 15. For example, if an SMA material such as NITINOL is selected for SMA wire 15, it is known that NITINOL wire shrinks by 4% when activated. Thus, the relaxed length of SMA wire 15 should be chosen such that the ratio y/x is equal to approximately 0.04. While this is not the maximum shrinkage attainable, (i.e., SMA wire 15 could be supplied with a greater heating current), it is the recommended amount of permitted shrinkage that allows thousands of shrink-relax cycles. Of course, it should be appreciated that many other SMA materials may be used for SMA wire 15.

As SMA wire 15 shrinks, guide means 19 provides for its unrestricted movement. Once in its erect position, antenna 10 is free of the surface of the water (and wash over) so that the tow vehicle may transmit/receive communications in an uninterrupted fashion. When it is no longer necessary to maintain antenna 10 in its erect position, the heating current I is removed or turned off at the tow vehicle. This allows SMA wire 15 to cool in the seawater and relax to its non-activated length. The spring bias of hinge 11 will then stretch the cooling SMA wire 15 thereby returning antenna 10 to its stowed position as shown in FIG. 2. The spring bias of hinge 11 is further augmented by the hydrodynamic forces acting an antenna 10 from the water flow 101 past cable 100. At the same time, the flow 101 is useful to remove any debris (seaweed, kelp, etc.) that collects on antenna 10 when it is in its erect position.

While the present invention has been described relative to a specific embodiment, it is not so limited. The present invention may be further enhanced by providing a tension relief spring 20 (shown only in FIG. 3) in line with SMA wire 15. The exact positioning of spring 20 is not critical. Spring 20 would allow antenna 10 to be "knocked down" from its erect position to the stowed position if it were to be hit by an object in the water. Thus, spring 20 must be stiffer than the force required to hold antenna 10 erect but also stretch the distance y at a force less than that necessary to damage SMA wire 15.

The advantages of the present invention are numerous. The SMA actuator system allows a communications antenna to be erected from a buoyant cable simply and quietly. Once erected, the antenna extends above the surface of the water to allow a tow vehicle to achieve uninterrupted communications using higher radio frequency waves (resulting in higher data rates) than previously possible with the conventional towed buoyant communications cable. When communication has been completed, the antenna can be restored to its stowed position to maintain tow vehicle stealth and to allow for high speed tow vehicle maneuvers without damage to the communication antenna.

It will also be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An apparatus for erecting and stowing a communications antenna from an underwater buoyant cable wherein, in its stowed position, the antenna is approximately parallel to the cable, and in its erected position, the antenna is approximately perpendicular to the cable, said apparatus comprising:

a hinge connected to the cable and to the antenna, said hinge being further spring biased to maintain the antenna in its stowed position; and actuator means, connected to the cable and the antenna, for overcoming the spring bias of said hinge to raise the antenna to its erected position when energy of activation is supplied thereto, and for allowing the spring bias of said hinge to return the antenna to its stowed position when the energy of activation is removed therefrom, wherein said actuator means is a shape memory alloy wire and wherein the energy of activation is heating current, whereby the energy of activation is heating current, whereby said wire shrinks to raise the antenna to its erected position when the heating current is supplied thereto, and relaxes to its non-activated length when the heating current is removed therefrom.

2. An apparatus as in claim 1 wherein said hinge comprises a leaf spring.

3. An apparatus as in claim 1 further comprising a tension relief spring in line with said shape memory alloy wire, whereby the antenna can be disturbed while in its erected position without damage to said shape memory alloy wire.

4. An apparatus for erecting and stowing a communications antenna from an underwater buoyant cable that houses a plurality of electric current carrying lines wherein, in its stowed position, the antenna is approximately parallel to and maintained within the circumferential confines of the cable, and in its erected position, the antenna is approximately perpendicular to the cable, said apparatus comprising:

a hinge connected to the cable and to one end of the antenna, said hinge maintained within the circumferential confines of the cable, said hinge being further spring biased to maintain the antenna in its stowed position wherein, in its stowed position, the other end of the antenna points substantially in the direction of water flow past the cable; and actuator means, connected to the cable and the antenna within the circumferential confines of the cable, for overcoming the spring bias of said hinge to raise the antenna to its erected position when energy of activation is supplied thereto, and for allowing the spring bias of said hinge to return the antenna to its stowed position when the energy of activation is removed therefrom.

5. An apparatus as in claim 4 wherein said hinge comprises a leaf spring.

6. An apparatus as in claim 4 wherein said actuator means comprises a shape memory alloy wire wherein the energy of activation is heating current supplied via one of the electric current carrying lines, whereby said wire shrinks to raise the antenna to its erected position when the heating current is supplied thereto, and relaxes to its non-activated length when the heating current is removed therefrom.

7. An apparatus as in claim 6 further comprising a tension relief spring in line with said shape memory alloy wire, whereby the antenna can be disturbed while in its erected position without damage to said shape memory alloy wire.

8. An apparatus for erecting and stowing a communications antenna from an underwater buoyant cable that houses a plurality of electric current carrying lines wherein, in its stowed position, the antenna is approximately parallel to and maintained within the circumferential confines of the cable, and in its erected position, the antenna is approximately perpendicular to the cable, said apparatus comprising:

a hinge connected to the cable and to one end of the antenna, said hinge being further spring biased to maintain the antenna in its stowed position wherein, in its stowed position, the other end of the antenna points substantially in the direction of water flow past the cable;

a shape memory alloy wire connected on one end to the cable and on the other end to the antenna, said wire being further electrically connected to one of the electric current carrying lines to allow for the application of heating current thereto, whereby said wire shrinks to raise the antenna to its erected position when the heating current is supplied thereto, and relaxes to its non-activated length when the heating current is removed therefrom; and means, mounted on the cable, for guiding said wire as it shrinks and relaxes.

9. An apparatus as in claim 8 wherein said hinge comprises a leaf spring.

10. An apparatus as in claim 8 further comprising a tension relief spring in line with said shape memory alloy wire, whereby the antenna can be disturbed while in its erected position without damage to said shape memory alloy wire.

* * * * *